US006581344B1

(12) United States Patent
Niewiadomski et al.

(10) Patent No.: US 6,581,344 B1
(45) Date of Patent: Jun. 24, 2003

(54) FRAME SYSTEM

(75) Inventors: Mitchell Niewiadomski, Lowell, MI (US); Frederick S. Faiks, Greenville, MI (US)

(73) Assignee: Steelcase Development Corporation, Caledonia, MI (US)

( * ) Notice: Subject to any disclaimer, the term of this patent is extended or adjusted under 35 U.S.C. 154(b) by 63 days.

(21) Appl. No.: 09/724,193

(22) Filed: Nov. 28, 2000

(51) Int. Cl.[7] ..... E04B 2/74

(52) U.S. Cl. ..... 52/239; 52/36.1; 52/241; 52/263; 248/221.11; 160/369

(58) Field of Search ..... 52/36.1, 36.4, 52/36.5, 126.3, 126.5, 220.7, 238.1, 239, 263; 248/218.4, 220.21, 221.11; 160/135, 368.1, 369, 351; 403/326, 329

(56) References Cited

U.S. PATENT DOCUMENTS 5,386,674 A * 2/1995 Sfirakis et al. ..... 52/243.1
5,794,392 A 8/1998 Forslund, III et al.
6,108,989 A * 8/2000 Kordes et al. ..... 52/243.1
6,209,266 B1 * 4/2001 Branc et al. ..... 52/36.1
6,216,397 B1 * 4/2001 Chang ..... 52/36.1
6,250,020 B1 * 6/2001 Shipman ..... 52/36.1
6,282,847 B1 * 9/2001 Mangelsen et al. ..... 52/36.1
6,282,854 B1 * 9/2001 Vos et al. ..... 52/239
6,430,880 B1 * 8/2002 Kemeny ..... 52/71

* cited by examiner

*Primary Examiner*—Carl D. Friedman
*Assistant Examiner*—Jennifer I. Thissell
(74) *Attorney, Agent, or Firm*—Foley & Lardner

(57) ABSTRACT

A workstation for a work environment having a floor is disclosed. The workstation includes a plurality of frame sections, and a latch mechanism releasably and rigidly securing at least one frame section to the floor. The latch mechanism includes a latch coupled to one of the frame sections, a wedge coupled to the latch, and a clip disposed between the latch and the wedge. The clip has a pair of flanges with ends capable of being disposed at least partially beneath the floor. The latch is configured to move the wedge between the flanges of the clip to operate the latch mechanism between a latched position and a released position so that the workstation may be quickly and easily disassembled. A workstation for a work environment having a floor having an aperture is also disclosed. The workstation includes among other features a latch mechanism having a sleeve and a wedge that may be inserted into the sleeve so that an end is at least partially disposed within the aperture.

35 Claims, 11 Drawing Sheets

FRAME SYSTEM

FIELD OF THE INVENTION

The present invention relates to a frame system. More specifically, the present invention relates to a lightweight frame system for a workstation.

BACKGROUND

Frame systems for workstations or the like in the work or office environment are generally known. Such known frame systems may include partial height partition walls that are installed to form workstations and work areas. Such known frame systems typically have the structural rigidity that is often required in a work environment for configuring work spaces in a work environment. However, such known frame systems tend to include relatively substantial elements and to require a relatively substantial amount of time, labor, planning to install, configure and reconfigure (if reconfigurable at all). It is also known to provide for frame system having "lightweight" structural elements. However, such lightweight frame systems tend to lack the structural strength and rigidity of other frame systems and also tends to be relatively time-consuming to install.

Accordingly, there is a need for a lightweight frame system that provides structural rigidity and may be relatively quickly and relatively easily assembled and disassembled, configured or reconfigured, and the like. It would also be advantageous to provide a frame system that is lightweight and yet provides suitable strength and rigidity for a work environment. It would further be advantageous to provide a lightweight frame system that reduces manufacturing shipping and assembly costs in many applications, that is quickly and easily reconfigurable, and that uses modular components (e.g., members, connectors, panels, etc.).

It would be desirable to provide for a frame system having one or more of these or other advantageous features.

SUMMARY

The present invention relates to a workstation for a work environment having a floor. The workstation includes a plurality of frame sections having vertical posts attachable to the floor, a plurality of panels interconnectable to at least one of the frame sections, a worksurface attachable to at least one of the lightweight frame sections, and a latch mechanism releasably and rigidly securing the vertical posts of the frame sections to the floor. The latch mechanism operates between a released position and latched position so that the workstation may be quickly and easily attached to and detached from the floor.

The present invention also relates to a workstation for a work environment having a floor. The workstation includes a plurality of frame sections having vertical posts attachable to the floor, and a latch mechanism releasably and rigidly securing at least one frame section to the floor. The latch mechanism includes a latch coupled to one of the frame sections, a wedge coupled to the latch, and a clip disposed between the latch and the wedge. The clip having a pair of flanges with ends capable of being disposed at least partially beneath the floor. The latch is configured to move the wedge between the flanges of the clip to operate the latch mechanism between a latched position and a released position so that the workstation may be quickly and easily disassembled.

The present invention further relates to a workstation for a work environment having a floor having an aperture. The workstation includes a plurality of frame sections having vertical posts attachable to the floor, and a latch mechanism releasably and rigidly securing at least one frame section to the floor. The latch mechanism includes a sleeve coupled to one of the frame sections, and a wedge configured to be inserted into sleeve. The wedge is configured to be inserted into the sleeve so that an end of the wedge is at least partially disposed within the aperture so that the workstation may be quickly and easily disassembled.

DETAILED DESCRIPTION OF PREFERRED AND OTHER EXEMPLARY EMBODIMENTS

Referring to the FIGURES, a frame system is shown for use in association with a work environment that may include one or more workstations. For purposes of any exemplary or alternative embodiments, the work environment may be of any type generally providing a work space for one or more workers. The work space may be divided or otherwise arranged to provide one or more work areas for use by the workers, who may be engaged in any of a wide variety of individual activities or group activities, for example, as may be performed by members of a project team or department.

As indicated in FIGURES, the frame system may be adapted for use within the work environment or include workstations in wide variety of arrangements, each intended to support individual or collaborative activities of one or more workers. The frame system is configured to provide various combinations of shapes, sizes and configurations (e.g., modularity, selective arrangement, etc.) Workstations may be configured within the work environment by including one or more articles of furniture within the work areas in support of the workers and their activities (which may or may not be coupled to the frame system). According to a preferred embodiment, the work environment will be defined at least partially by one or more wall sections (e.g., architectural walls and/or a system of panel or partition walls, such as partial height partitions). As will be shown with reference to exemplary embodiments, the work environment and associated frame system and wall sections may be arranged to include any of a wide variety of articles of furniture and other associated elements, including additional panel walls and worksurfaces configured in any of a wide variety of orientations, chairs or other seating products, storage or case-goods products, tables and other worksurfaces, information display systems, lighting products or systems, as well as other accessories, electronic or computing equipment and other systems (with associated connectivity such as cabling) known and used in the work environment.

Figure 1:
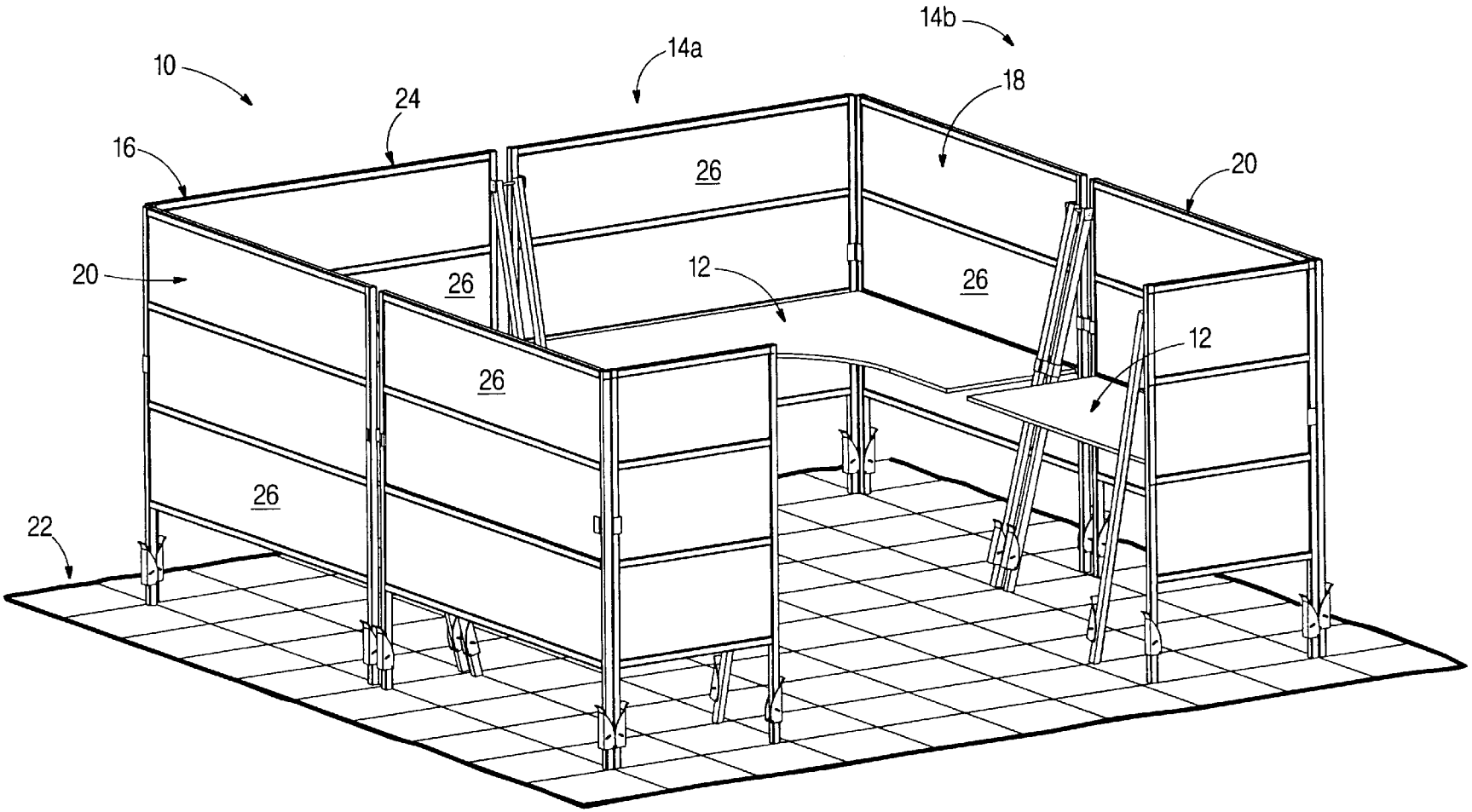
FIG. 1 is a perspective view of a work environment according to an exemplary embodiment of the present invention.

Referring to FIG. 1, a work environment 20 defining one or more work areas (Shown as a work area 14*a* and a work area 14*b*) is shown. Work areas 14*a*, 14*b* are defined by one or more wall sections 16 and include one or more workstations 18 (which are provided with one or more work spaces 12). Each workstation 18 can be configured for use by one or more workers (not shown) working independently in separate work areas and to include one or more articles of furniture (e.g., a shelving unit, a mobile table, a chair, and the like (not shown)).

Wall section 16 includes a plurality of walls 20 secured to a floor 22 and in a generally upright or vertical position by a frame system 24. Each wall may include one or more panels 26 (e.g., screens, coverings, sheets, tales, skins, etc.) arranged in any of a variety of ways (four panels arranged vertically is shown in FIG. 1).

Figure 2:
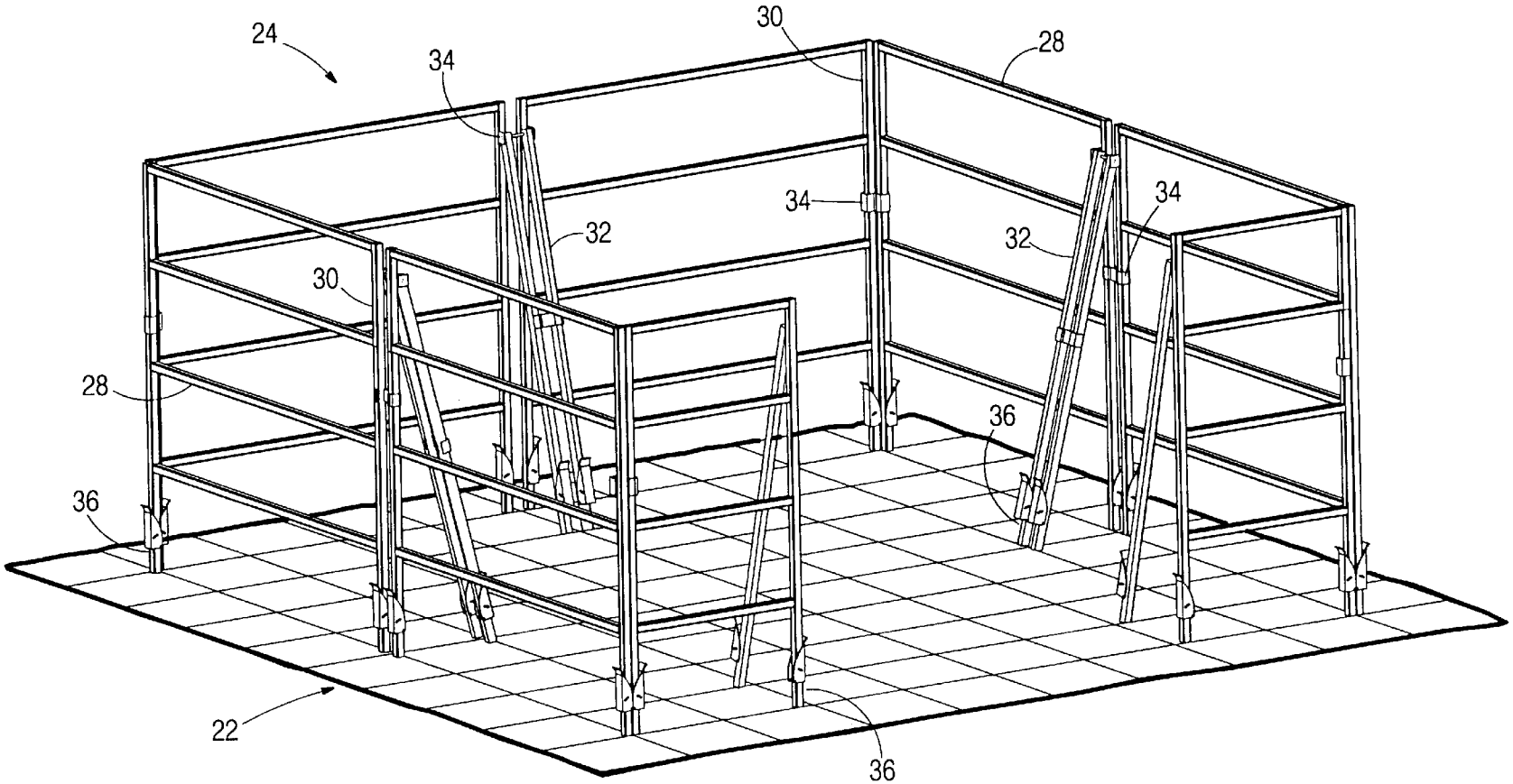
FIG. 2 is a perspective view of a frame system for the work environment of FIG. 1.

As shown in FIG. 2, frame system 24 includes a plurality of horizontal frame members (shown as a beam 28), a vertical frame member (shown as a post 30), and an angled frame member (shown as an angled support 32) coupled to one another by connectors 34. According to an alternative embodiment, any of a variety of frame members may be used to secure the walls to the floor (e.g., crossing members, rails, columns, tubes, supports, braces, etc.). Posts 30 and angled supports 32 are rigidly secured to floor 22 by latch mechanisms (shown as latch mechanism 37 in FIGS. 3A–3C, latch mechanism 38 in FIGS. 3D–3H, or latch mechanism 36 in FIGS. 1, 2, and 3I–3K). Latch mechanism 37, 38 and 36 is intended to quickly and easily couple a frame member 40 (e.g., post 30, angled support 32, etc.) to a floor tile 42 of floor 22. Floor tile 42 is supported by a pad 44 on a subfloor or base 46 and attached to pad 44 by a fastener (shown as a screw 35). The floor arrangement is further illustrated in U.S. Pat. No. 5,794,392, which is incorporated by reference herein. According to an alternative embodiment, the floor may have any of a variety of configurations, construction, and design which are configured to couple to one or more latch mechanisms.

Figure 3A:
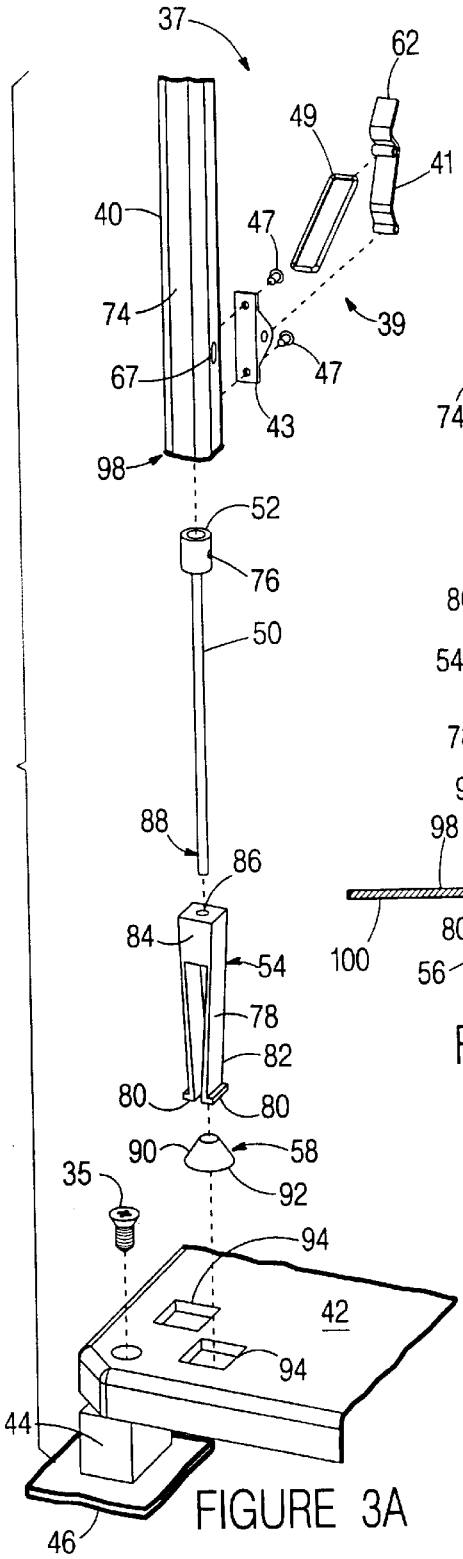
FIG. 3A is a fragmentary exploded perspective view of a latch mechanism according to an exemplary embodiment.
Figure 3B:
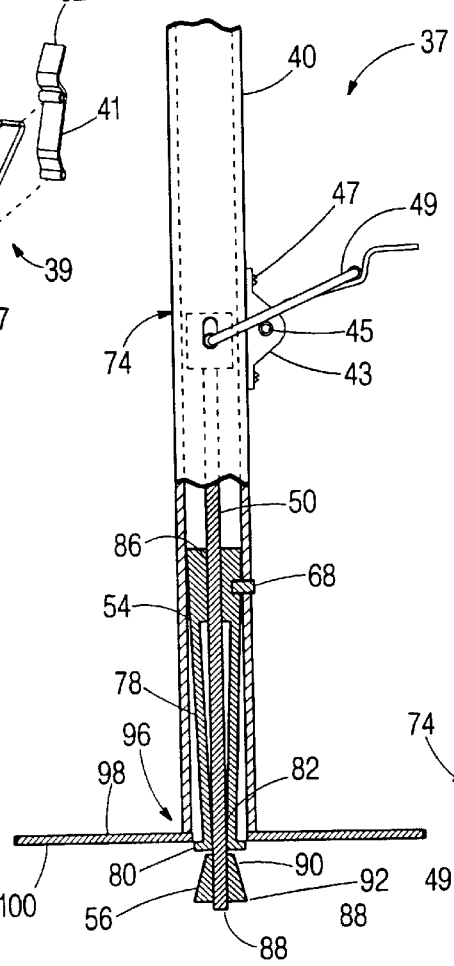
FIGS. 3B and 3C are fragmentary side sectional views of the latch mechanism of FIG. 3A.
Figure 3C:
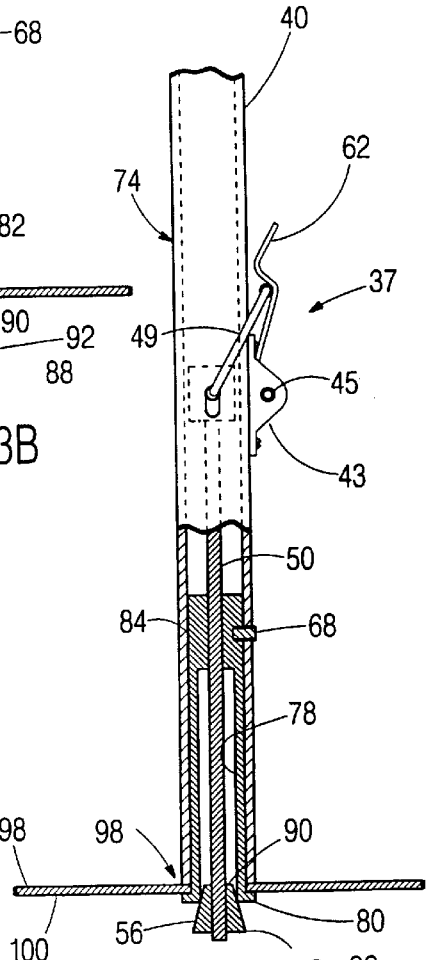
Figure 3G:
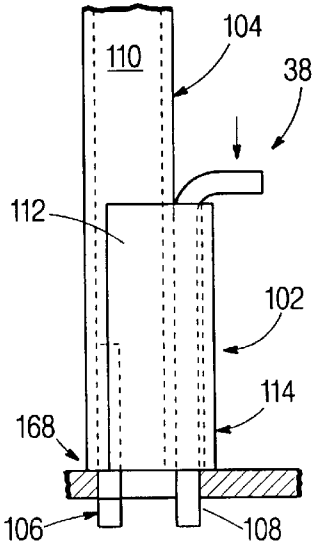
FIGS. 3E through 3G is a fragmentary side sectional view of the latch mechanism of FIG. 3D.
Figure 3F:
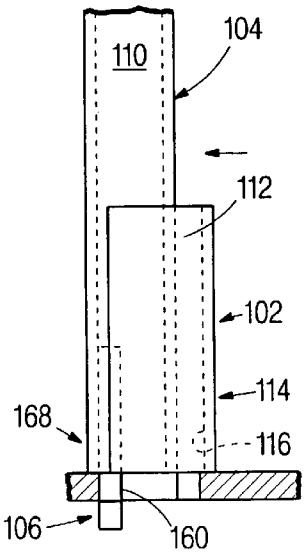
Figure 3H:
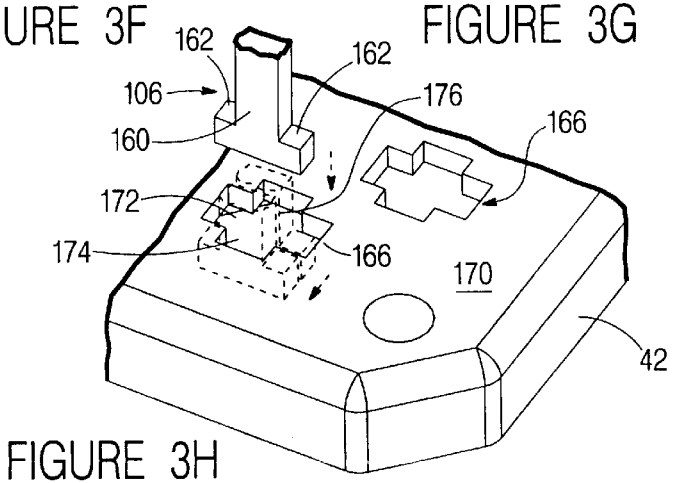
FIG. 3H is a fragmentary exploded perspective view of the latch mechanism of FIG. 3D.
Figure 3E:
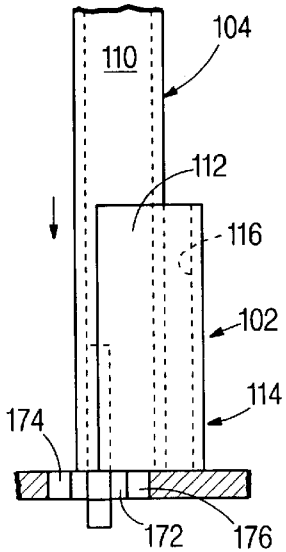
Figure 3D:
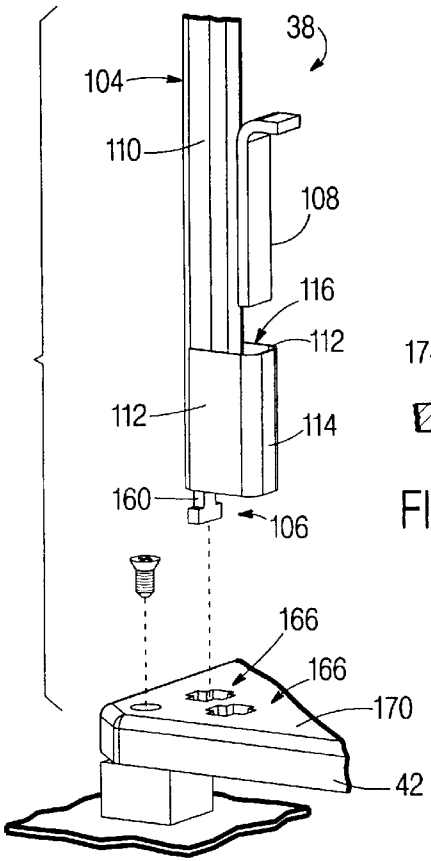
FIG. 3D is a fragmentary exploded perspective view of a latch mechanism according to an exemplary embodiment.

Referring to FIGS. 3A–3C, latch mechanism 37 is shown according to an exemplary embodiment. Latch mechanism 37 includes a latch 39, a rod 50 with a head 52, a retaining member (shown as a fork or clip 54) coupled to rod 50, and a wedge 56.

Latch 39 includes an arm 41 that is coupled to a base 43 and configured to pivot about a pivot point 45. A tab 62 extends from arm 41 to provide a user interface to grasp and operate latch 39. Base 43 is mounted to frame member 40 (e.g., post 30, or angled support 32, etc.) with fasteners (shown as screws 47). Arm 41 is also coupled to rod 50 by a loop 49 that engages an aperture 76 defined by head 52.

Latch 39 may be coupled to frame member 40 in any of a variety of positions and orientations (e.g., with respect to its distance from the floor, position and orientation of the latch, etc.). According to a preferred embodiment, latch 39 for work area 14*a* is coupled to frame member 40 a distance above floor 22 and orientated so that member 60 and tab 62 are disposed generally in work area 14*a* (e.g., so as to not interfere with another wall section for work area 14*b* that may be positioned next to work area 14*a*).

Rod 50 is at least partially disposed within frame member 40 and includes head 52 coupled to one end. Head 52 of rod 50 includes an aperture 76 configured to receive loop 49 so that it may move in slot 67 when arm 41 is actuated.

Clip 54 is held in position inside frame member 40. According to a preferred embodiment, clip 54 is held in position inside frame member 40 by a fastener (shown as a set screw 68). Clip 54 includes a pair of arms 78 terminating with opposing flanges 80 having upper surfaces 82. An upper portion 84 of clip 54 includes an aperture 86 configured to slidably receive rod 50. According to a preferred embodiment, arms 78 of clip 54 are biased generally inward (see FIGS. 3A and 3B).

Wedge 56 is coupled to an end 88 of rod 50 and includes a narrow end 90 and a wide end 92. According to a preferred embodiment, wedge 56 is generally conical in shape with narrow end disposed near flanges 80. According to an alternative embodiment, the wedge but may be any of a variety of shapes and configurations that activates the clip into an engaged position (e.g., planar or "ramp" shaped with a triangular cross-section, etc.), and may be coupled to rod 50 by any of a variety of techniques (e.g. threaded, fastened, welded, by a nut, etc.).

FIGS. 3B and 3C show actuation of latch mechanism 39, which is to rigidly secure frame member 40 to floor tile 42 of floor 22. (FIG. 3B shows latch mechanism 39 in a disengaged position (or unlatched, unsecured, non-rigid, etc.)) FIG. 3C shows latch mechanism 39 in an engaged position (or latched, secured, rigid, etc.). To secure frame member 40 to floor tile 42, arms 78 of clip 54, and wedge 56 attached to end of rod 50 are positioned in an aperture 94 in floor tile 42. According to a preferred embodiment, latch mechanism 39 and floor tile 42 are configured so that arms 78 and wedge 56 maybe quickly and easily inserted through aperture 94. An end 96 of frame member 40 is positioned against an upper surface 98 of floor tile 42. To engage latch mechanism 37 to secure frame member 40 to floor 22, arm 41 of latch 39 is pivoted so it is generally parallel with frame member 40. As arm 41 pivots, loop 49 moves generally upward in slot 67, which moves rod 50 and wedge 56 generally upward. As wedge 56 moves generally upward, the outer surface of wedge 56 separates flanges 80 of arms 78 until upper surface 82 of flanges 80 is disposed outside of aperture 94 in floor tile 42 (i.e., adjacent underside 100 of floor tile 42). As such, mechanism 39 is intended to rigidly secure lightweight frame system 24 to floor 22 until latch mechanism 39 is disengaged.

Referring to FIGS. 3D through 3H, latch mechanism 38 is shown according to an exemplary embodiment. Latch mechanism 38 includes a sleeve 102 coupled to a frame member 104 (e.g., post 30, angled support 32, etc.), a non-invasive fastener (shown as an interface or a "T-shaped" member 106), and a wedge 108. Sleeve 102 is coupled to opposite sides 110 of frame member 104 (e.g., by fasteners, welding, snap or interference fit, etc), and includes a pair of sidewalls 112 connected by a wall 114 intermediate sidewalls 112 which together define a space (shown as a track 116) between sleeve 102 and frame member 104.

According to a preferred embodiment, interface member is "T-shaped" and includes a neck 160 and an upper surface 162. According to alternative embodiments, the interface member is any of a variety of shapes and configurations configured to provide a secure and rigid engagement (e.g., by an interference between the interface member and the floor tile) between the frame member and the floor. According to alternative embodiments, the non-invasive fastener is shaped and designed to provide an interference interface with the floor (e.g., by geometric configurations of members and fasteners, etc.).

To secure frame member 104 to floor tile 42, T-shaped member 106 is inserted into an aperture (shown as a "cross-shaped" aperture 166) in floor tile 42 so that an end 168 of frame member 104 and sleeve 102 rest against upper surface 170 of floor tile 42. According to a preferred embodiment, aperture 166 is shaped to provide flexibility in mounting and engagement arrangements. According to alternative embodiments, the aperture may be any of a variety of shapes and configuration that co-act with interface member to secure the frame member to the floor. Cross-shaped aperture 166 includes a wide portion 172 and a pair of narrow portions 174, 176.

After T-shaped member 106 is inserted into wide portion 172, frame member 104 is moved (e.g., slid across floor tile 42) so that neck 160 is positioned in narrow portion 174 of cross-shaped aperture 166 (and track 116 is disposed substantially above narrow portion 176 and opposite narrow portion 174). Wedge 108 is inserted (e.g., slid) through track 116 and into narrow portion 176 so that neck 160 may not move out of narrow portion 174 and upper surface 162 is positioned beneath underside 100 of floor tile 42. To disengage, wedge 108 is removed from narrow portion 176 and track 116 of sleeve 102. Frame member 104 is moved (e.g., slid) away from narrow portion 174 so that upper surface 162 of T-shaped member 106 is positioned in wide portion 172 (i.e. no longer in interference with the floor tile).

By securing frame members (e.g., post 30, angled support 32, etc.) in rigid engagement with floor 12, lightweight wall sections 16 may be used to form work space 12. Such light weight construction is intended to provide quick and easy assembly and disassembly, configuration and reconfiguration, reduce space (i.e., "footprint") used by wall section 16, reduce cost of wall sections 16, provide easier handling, and the like. By providing a rigid wall section, it is intended to provide comparable performance and usefulness as standard wall sections.

T-shaped member 106 is coupled to a side 117 of frame member 104 opposite track 116 (e.g., by fasteners, welding, adhesive, snap or interference fit, etc.).

Figure 3I:
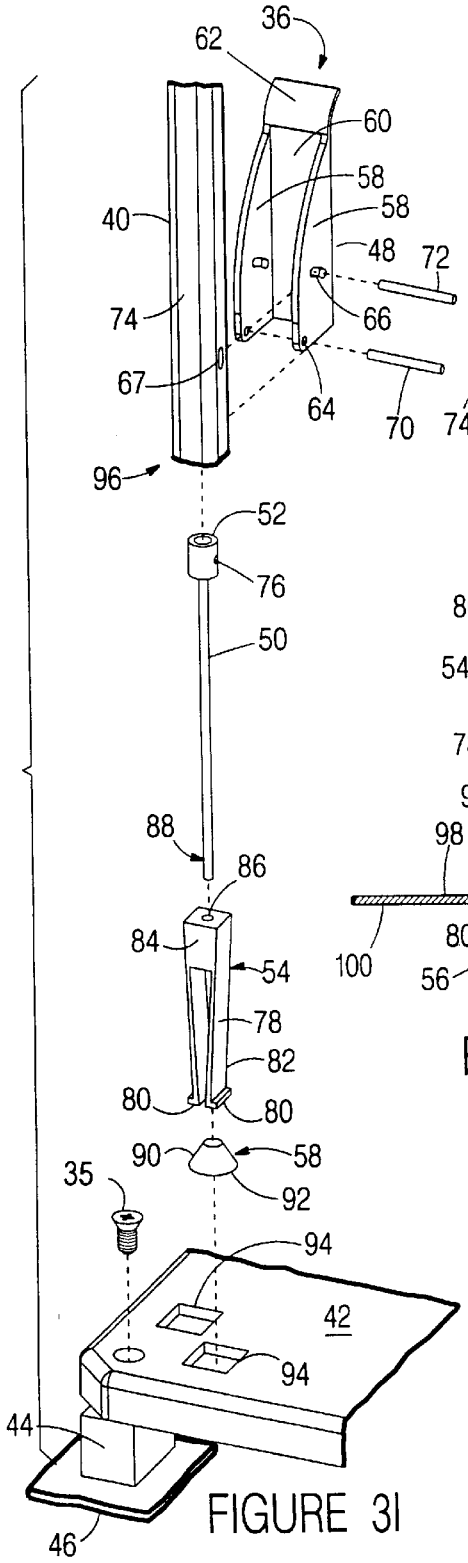
FIG. 3I is a fragmentary exploded perspective view of a latch mechanism of the work environment of FIG. 1.
Figure 3J:
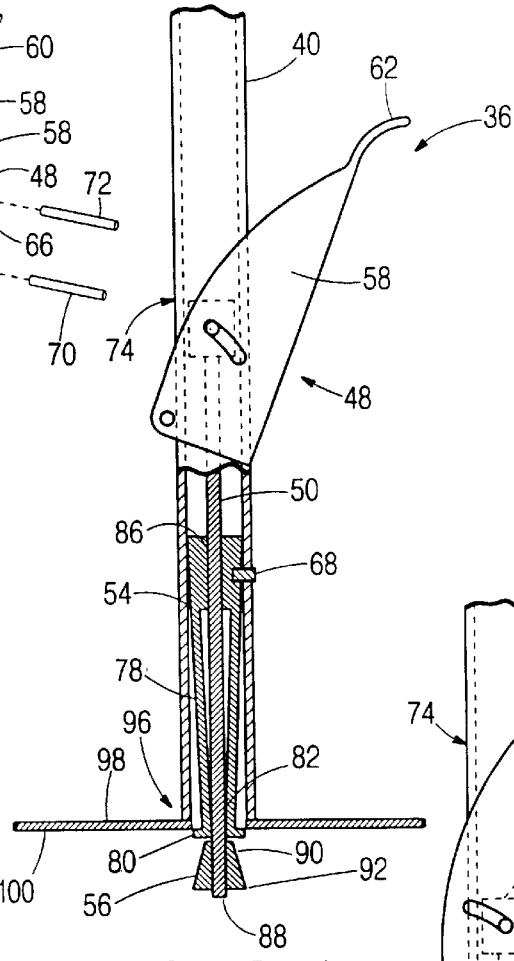
FIGS. 3J and 3K are fragmentary side sectional elevation views of the latch mechanism of FIG. 3I.
Figure 3K:
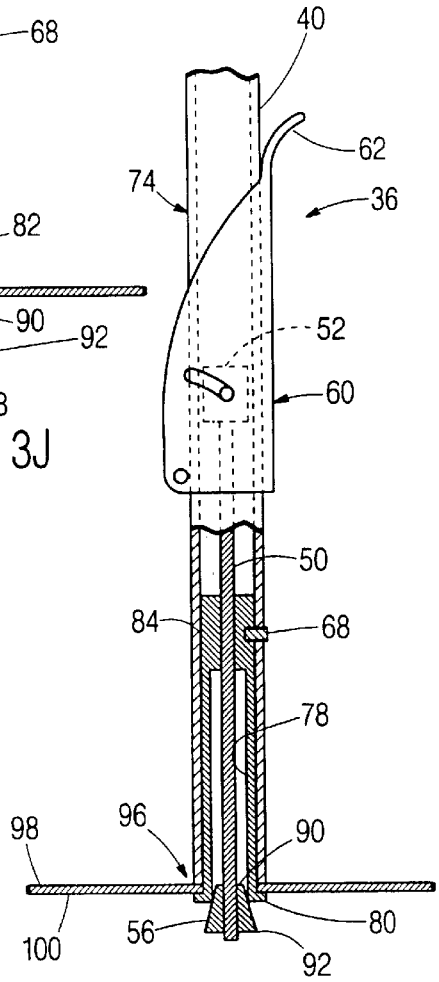

Referring to FIGS. 3I–3K, latch mechanism 36 is shown according to an exemplary embodiment. Latch mechanism 36 includes a latch 48, rod 50 with to head 52, clip 54 coupled to rod 50, and a wedge 56. Latch 48 includes a pair of sides 58 connected by a member 60 between sides 58. Tab 62 extend from member 60 to provide a user interface to grasp and operate latch 48. Each side 58 includes an aperture 64 and a slot (shown as a slot 66, providing a cam surface). Latch 48 is movably coupled to frame member 40 (e.g., post 30, or angled support 32, etc.) by a pivot pin 70 and a cam pin 72. Latch 48 may be coupled to frame member 40 in any of a variety of positions and orientations (e.g., with respect to its distance from the floor, position and orientation of the latch, etc.). According to a preferred embodiment, latch 48 for work area 14*a* is coupled to frame member 40 a distance above floor 22 and orientated so that member 60 and tab 62 are disposed generally in work area 14*a* (e.g., so as to not interfere with another wall section for work area 14*b* that may be positioned next to work area 14*a*).

Pivot pin 70 is attached (e.g., fastened, welded, etc.) a side or face 74 of frame member 40 (e.g., opposite member 60) so that when latch 48 is operated, it pivots about pivot pin 70. Cam pin 72 is positioned in pair of slots 66 in opposing sides 58 of latch 48 and in slots 67 of frame member 40, and is configured to move up and down in slots 66 and slots 67 as latch 48 is operated.

FIGS. 3J and 3K show actuation of latch mechanism 36, which is to rigidly secure frame member 40 to floor tile 42 of floor 22. (FIG. 3J shows latch mechanism 36 in a disengaged position (or unlatched, unsecured, non-rigid, etc.)). FIG. 3K shows latch mechanism 36 in an engaged position (or latched, secured, rigid, etc.). To secure frame member, arms 78 of clip 54, and wedge 56 attached to end of rod 50 are positioned in an aperture 94 in floor tile 42. According to a preferred embodiment, latch mechanism 36 and floor tile 42 are configured so that arms 78 and wedge 56 maybe quickly and easily inserted through aperture 94. An end 96 of frame member 40 is positioned against an upper surface 98 of floor tile 42. To engage latch mechanism 36 to secure frame member 40 to floor 22, latch 48 is pivoted so that member 60 is adjacent frame member 40. As latch 48 pivots, cam slots 66 move cam pin 72 generally upward, which moves rod 50 and wedge 56 generally upward. As wedge 56 moves generally upward, the outer surface of wedge 56 separates flanges 80 of arms 78 until upper surface 82 of flanges 80 is disposed outside of aperture 94 in floor tile 42 (i.e., adjacent underside 100 of floor tile 42). As such, it is intended to rigidly secure lightweight frame system 24 to floor 22 until latch mechanism 36 is disengaged.

FIGS. 4A through 5D show a connector configured to couple two or more frame members 118 (e.g. beam 28, post 30, and/or angled support 32).

Figure 4B:
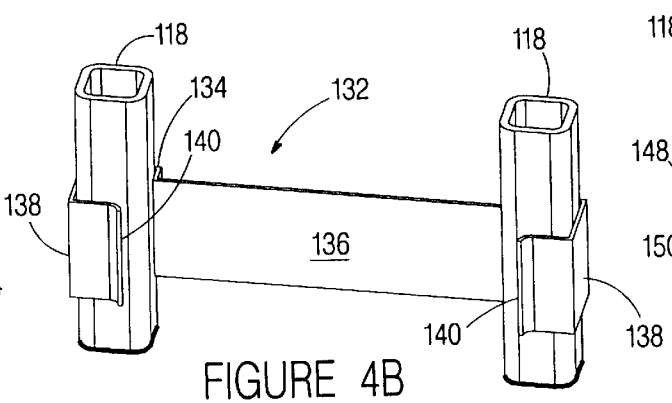
FIG. 4B is a fragmentary perspective view of a connector according to an exemplary embodiment.
Figure 4A:
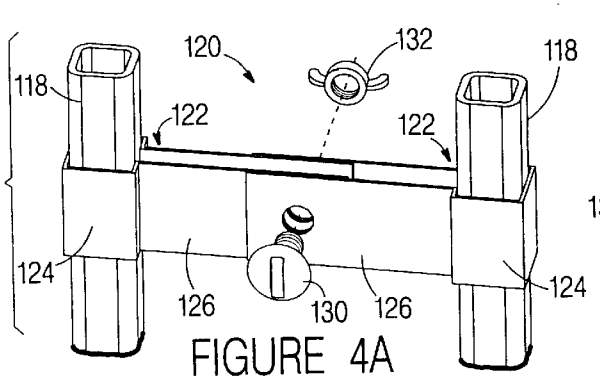
FIG. 4A is a fragmentary exploded view of a connector for the frame system of FIG. 2.

Referring to FIG. 4A, a connector 120 is coupled to adjacent wall sections 16 shown as forming a generally linear connection of frame members 118. Connector 120 includes a pair of brackets 122 having a sleeve 124 and a pair of flanges 126. To couple frame members 118, brackets 120 are slid over frame members 118 so that apertures 128 in flanges 126 line up and a fastener (shown as a screw 130) is inserted and held in place by a nut (e.g., wing nut 132). As shown in FIG. 4A, frame members 118 are generally square shaped. As such, sleeve 124 of bracket 122 is also square shaped. According to alternative embodiments, the frame member and the sleeve of the bracket are other shapes but similar to provide sufficient attachment.

Referring to FIG. 4B, a connector 132 is shown as a single bracket. Connector 132 includes a flange 136 and a pair of sleeves 138 configured to receive frame member 118. Each sleeve 138 includes a bend 134 so that there is a surface go on all sides of sleeve 138 (i.e., to "capture" frame members 118 and intended to prevent frame members 118 from moving closer to each other). A tab 140 extends from sleeve 138 and is intended to provide for easy release (e.g. easy and quick release, pop off or pull apart connection).

Figure 5A:
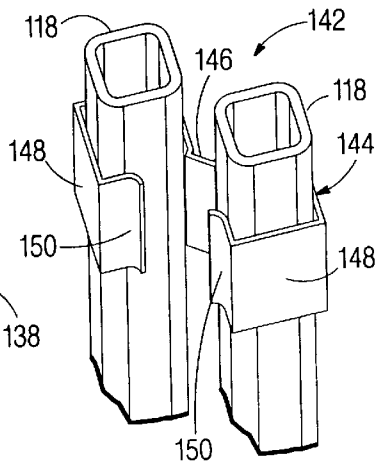
FIG. 5A is a fragmentary perspective view of a connector according to an exemplary embodiment.

Referring to FIG. 5A, a connector 142 is shown as a single bracket 144 configured to couple frame members 118 in a variety of positions or orientations (e.g., shown to form a corner). Bracket 144 includes a flange 146 and a pair of sleeves 148 configured to receive frame members 118. A bend 149 disposed between each sleeve 148 and flange 146 is intended to provide an additional surface (i.e., to "capture" frame members 118 and intended to prevent frame members 118 from moving closer to each other). A tab 150 extends from sleeve 148 and is intended for easy and quick release.

Figure 5D:
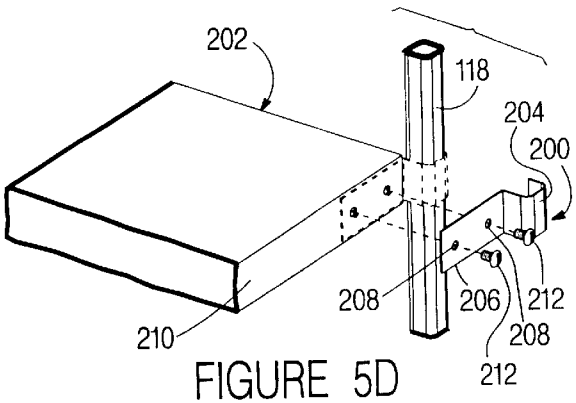
FIGS. 5B through 5D are fragmentary exploded perspective views connectors according to exemplary embodiments.
Figure 5C:
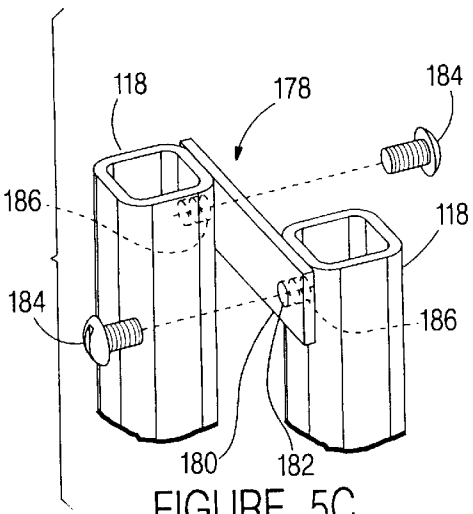
Figure 5B:
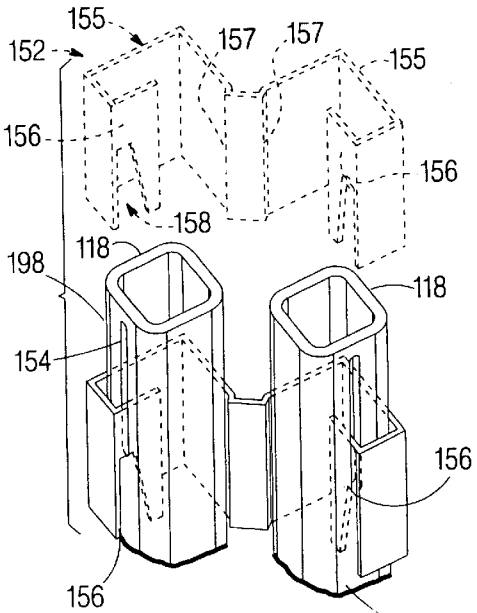

Referring to FIG. 5B, a connector 152 is shown as an exemplary embodiments of the bracket 144 of FIG. 5A. Connector 152 includes a pair of bracket ends 155 terminating at both ends with a "U-shaped" flange 156 (which defines a slot 158). Attachment of connector 152 to frame members 118 includes inserting flanges 156 into slots 154 in frame members 118 and sliding generally downward so that a side wall 198 of frame member 118 is positioned (e.g., "captured") by slot 154 and flange 156 of connector 152. Engagement of connector 152 includes positioning flanges 156 in slots 154 of frame members 118 so that slot 158 receives sidewall of frame member 118 and "projection" 157 to "capture" the frame member.

Referring to FIG. 5C, a connector 178 is shown configured to couple frame members 118 (e.g., shown in an offset linear orientation). Connector 178 includes a plate 180 with apertures 182 so that a fastener (shown as a screw 184) may be inserted into apertures 182 and threaded into apertures (shown as threaded holes 186) in frame members 118.

Referring to FIG. 5D, a connector 200 is shown configured to couple frame member 118 to worksurface 202 (e.g., so that worksurface may not be moved away from (pulled away from) wall 20 (e.g., by a worker getting up from chair, pulling himself/herself closer to work surface, etc.)). Connector 200 includes a sleeve 204 and a flange 206. Sleeve 204 is shaped and configured to engage frame member 118 (e.g., wrap at least partially around). According to a preferred embodiment, sleeve 204 is generally "C-shaped." According to alternative embodiments, the sleeve is any of a variety of shapes configured to engage any of a variety of frame members. Flange 206 includes apertures 208 and is attached to a side 210 of worksurface 202 by a pair of fasteners (shown as screws 212).

Figures 6A, 6B, 6C:
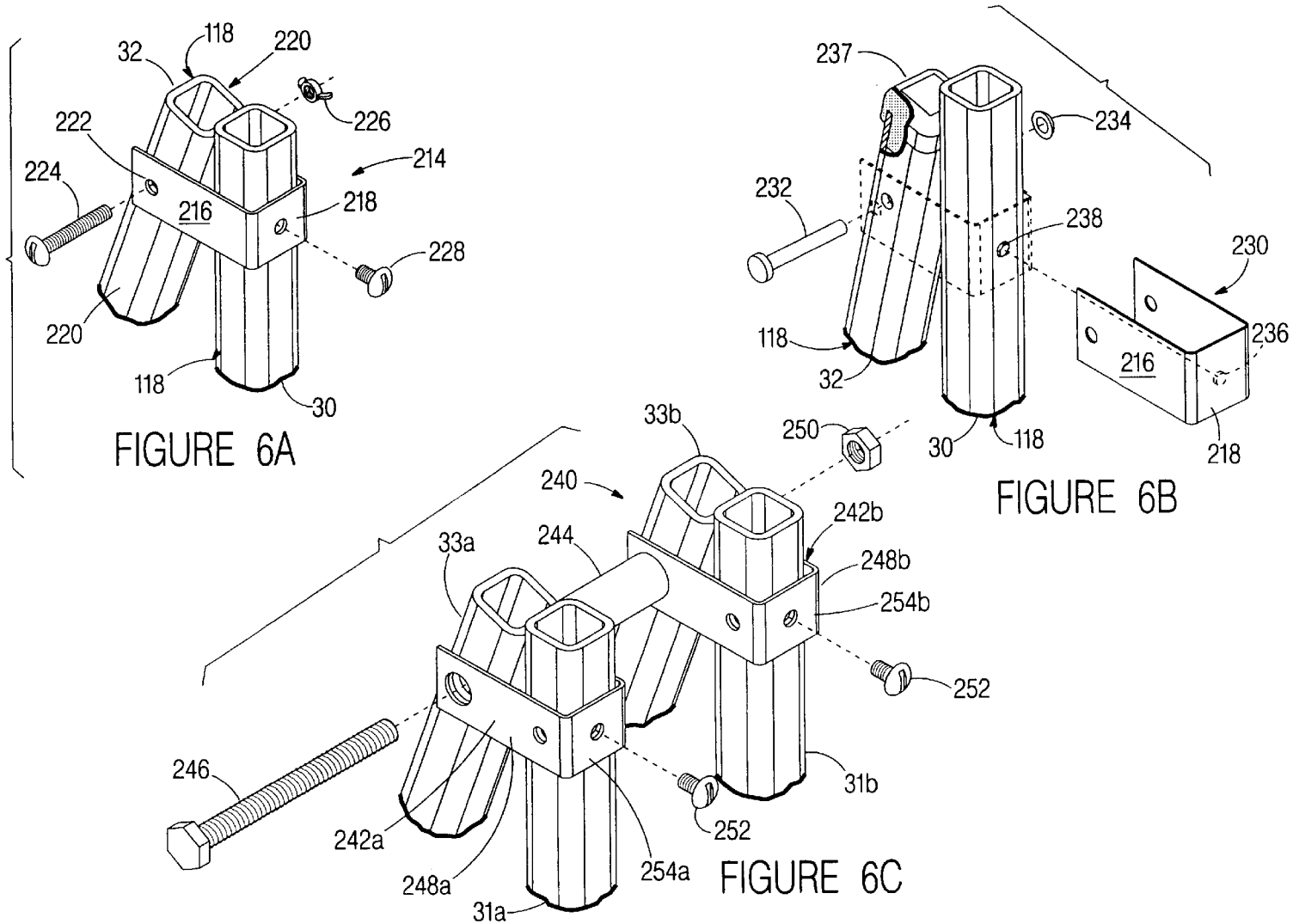
FIGS. 6A through 6C are fragmentary exploded perspective views of connectors according to exemplary embodiments for the frame system of FIG. 2.

Referring to FIG. 6A, a connector 214 is shown to couple a pair of frame members 118 (shown as post 30 and angled support 32). Connector 214 includes a pair of side flanges 216 connected by a flange 218 intermediate side flanges 216. Side flanges 216 and side walls 220 of angled support 32 include apertures 222 configured to receive a fastener (shown as a bolt 224) which is held in place by a nut (shown as a wing nut 226). Flange 218 is coupled to post 30 by a fastener 228.

Referring to FIG. 6B, a connector 230 is shown according to an alternative embodiment. Connector 230 is coupled to angled support 32 by a pin 232 and cap 234. A projection 236 on flange 218 is configured to engage a depression or hole 238 in post 30. A cap 237 is coupled to an end of frame member 118 (shown as angled support 32). Cap is intended to protect adjacent frame members and cover exposed ends and/or edges of the frame members and to provide a bias-interference member to induce a stress force between adjacent frame members (e.g., for rigidity and strength of the frame system). Cap 237 may be made from any of a variety of materials (e.g., natural rubber, buty/rubber, plastic (molded or cast), metal, etc.).

Referring to FIG. 6C, a connector 240 is shown to couple a pair of angled supports 33*a*, 33*b* and a pair of posts 31*a*, 31b. Connector 240 includes a pair of brackets 242*a*, 242*b*, coupled by a bridge 244 (e.g., a tube, spacer, etc.). A fastener (shown as a bolt 246) is inserted through apertures in outer flange 248*a* of bracket 242*a*, through angled support 33*a*, bridge 244, angled support 33*b*, and outer flange 242*b* of bracket 242*b*, which is secured with a nut 250. Fasteners 252 may be used to secure intermediate flanges 254*a*, 254*b* of brackets 242*a*, 242*b* to posts 31*a*, 31*b* and/or outer flanges 248*a*, 248*b* to opposing sides of posts 31*a*, 31*b*.

Figure 7D:
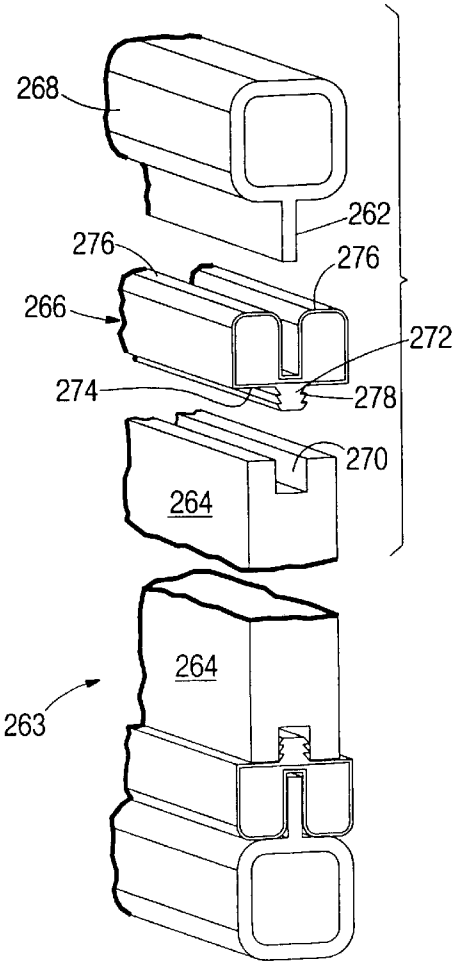
FIG. 7D is a fragmentary exploded perspective view of a wall of the work environment according to an exemplary embodiment.
Figure 7C:
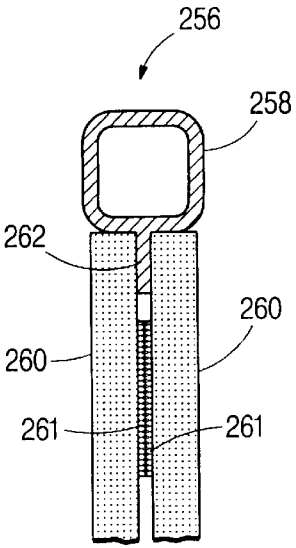
FIG. 7C is a fragmentary sectional view of the wall of 7B taken along line 7C—7C.
Figure 7A:
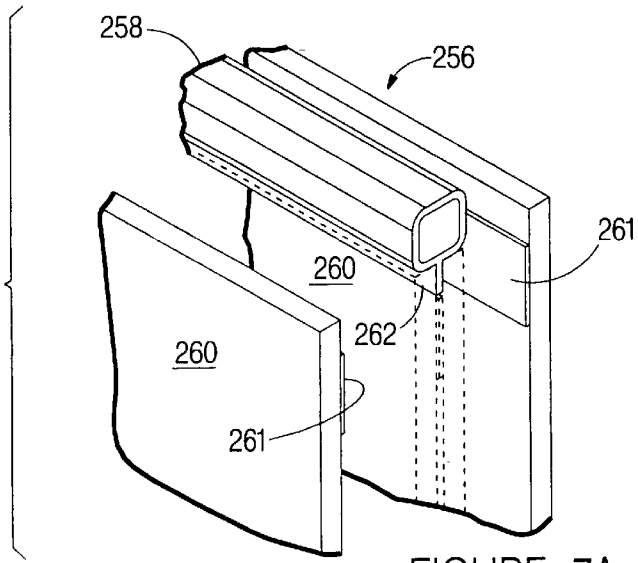
FIG. 7A is a fragmentary exploded perspective view of a wall according to an exemplary embodiment of the work environment of FIG. 1.
Figure 7B:
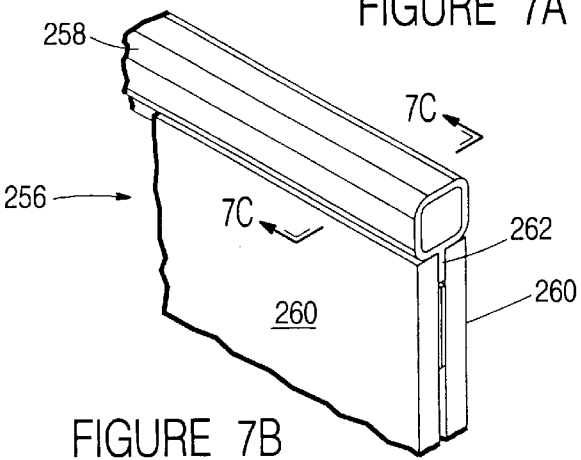
FIG. 7B is a fragmentary perspective view of the wall of FIG. 7A.

FIGS. 7A through 7C show a wall 256 according to an exemplary embodiment. Wall 256 includes a frame member 258 (e.g., beam 28, post 30, etc.) configured to be secured between a pair of panels 260. Frame member 258 includes a flange 262 extending therefrom and is configured to provide support for panels 260 when assembled. According to a preferred embodiment, frame member 258 is integrally formed (e.g., extruded elastomer or elastomeric material, plastic, metal, bent metal sheet, etc.). According to alternative embodiments, the frame member may be formed from multiple pieces (e.g., fastened, welded, glued, pressed, fabricated, etc.). A fastener (shown as a latch hook fastener 261 (e.g., Velcro)) is provided to couple panels 260. According to an alternative embodiment, the fastener may be adhesive tape (e.g., double-sided tape treated with a pressure sensitive adhesive), adhesive (e.g., glue), and the like.

FIG. 7D shows a wall 263 according to an exemplary embodiment. Wall 263 includes a panel 264, a molding (shown as an extrusion 266), and a frame member 268. Panel 264 includes a groove 270 configured to receive a projection 272 extending from a bottom surface 274 of extrusion 266. Extrusion 266 also includes a pair of ridge members 276 configured to receive flange 262 of frame member 268.

According to a preferred embodiment, projection 272 is a continuous "Christmas tree" fastener having ridges 278 configured to deform when pressed into groove 270. According to a particularly preferred embodiment, projection 272 is integrally formed with extrusion and made from any of a variety of elastomer materials (e.g., thermoplastic elastomer or TPE, natural rubber, butyl rubber, etc.). According to an alternative embodiment, the molding is a dual extrusion formed from different materials (e.g., a rigid plastic for the projection and a deformable plastic for the ridge members).

Figure 8B:
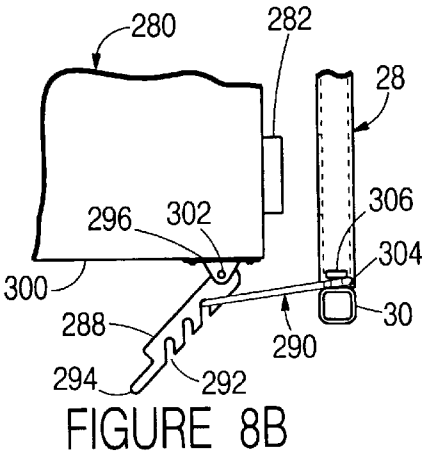
FIGS. 8B and 8C are fragmentary top elevation views of the work station of FIG. 8A.
Figure 8C:
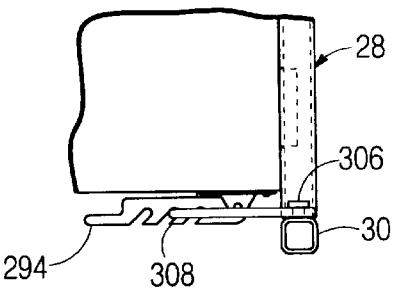
Figure 8A:
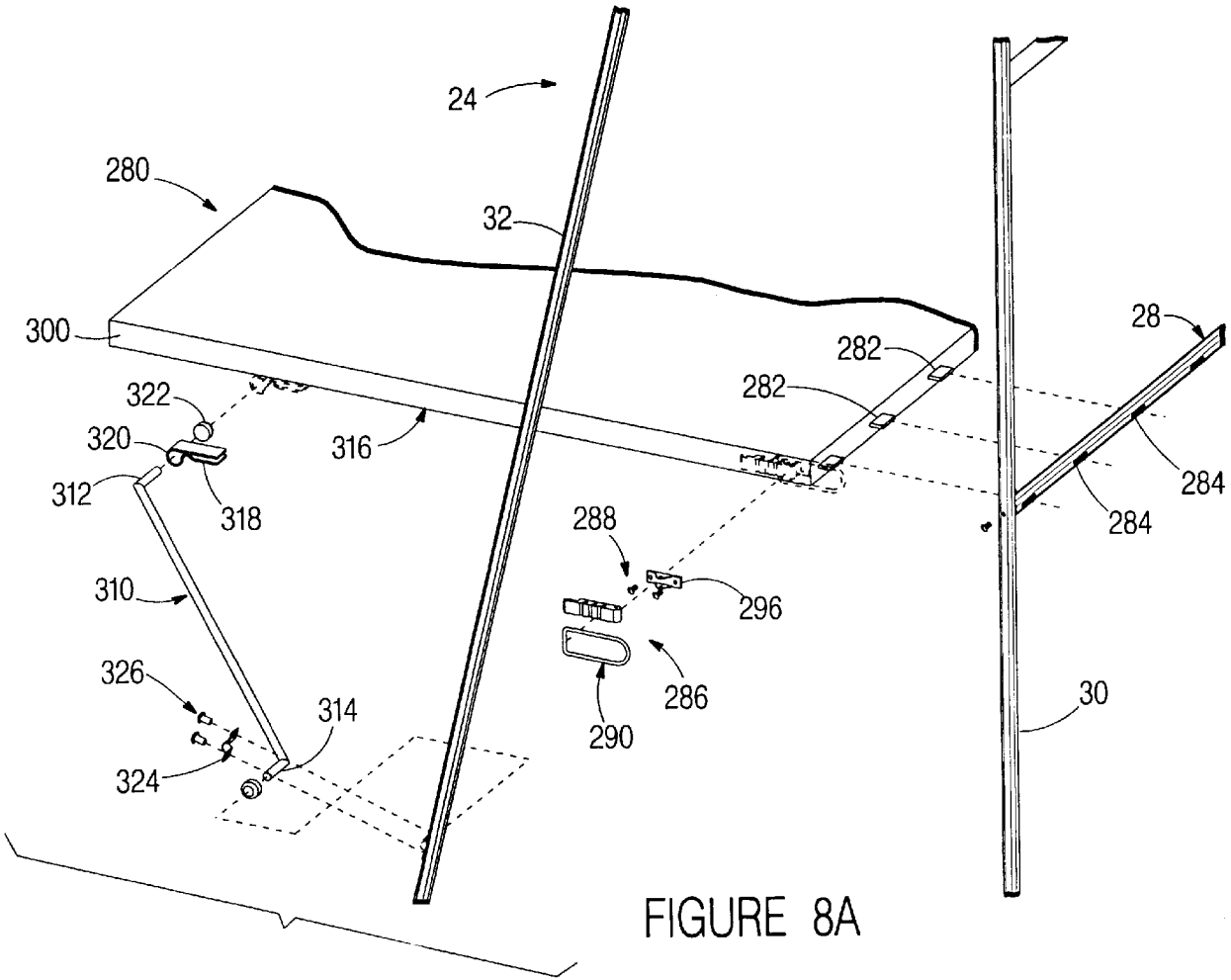
FIG. 8A is a fragmentary exploded perspective view of a workstation according to an exemplary embodiment.

FIGS. 8A through 8C show attachment of a worksurface 280 to frame system 24 according to an exemplary embodiment. Worksurface 280 couples to beam 28 (which is attached to post 30 (e.g., by a fastener or the like)) with engagement of one or more tabs 282 and corresponding slots 284 in beam 28 and a clamp 286. Engagement of tabs 282 and slots 284 is configured to provide (generally) vertical support for worksurface 280.

Clamp 286 includes a clip 288 and a loop 290. Clip 288 includes a plurality of grooves 292, a tab 294, and a pivoting base 296, pivoting base 298 is attached to a side 300 of worksurface 280 and provides a pivot point 302 for clip 288 to pivot about. One end 304 of loop 290 engages a shoulder bolt 306 attached to post 30. Another end 308 of loop 290 engages one of grooves 292 when clip 288 is in the open position (shown in FIG. 8A). As clip 288 is pivoted about pivot point to 302, loop 290 pulls worksurface 280 against beam 28 and post 30 until clip 288 "snaps" closed (shown in FIGS. 8C).

Worksurface 280 is coupled to angled support 32 by a support brace 310 configured to provide vertical and horizontal support. Support brace 310 includes a pair of opposed terminal ends (shown as an upper end 312 and a lower end 314). Upper end 312 is coupled to an underside 316 of worksurface with a bracket (shown as a "C-shaped" clip 318). Clip 318 is attached to underside 316 of worksurface 280 by any of a variety of techniques (e.g., fastener, adhesive, etc.). Upper end 312 is inserted through a track 320 and held in place with a cap 322. Lower end 314 of support brace 310 is coupled to angled support 32 by a bracket 324 (which is attached to angled support by any of a variety of techniques such as fasteners 326, welding, adhesive, etc.).

Figure 9C:
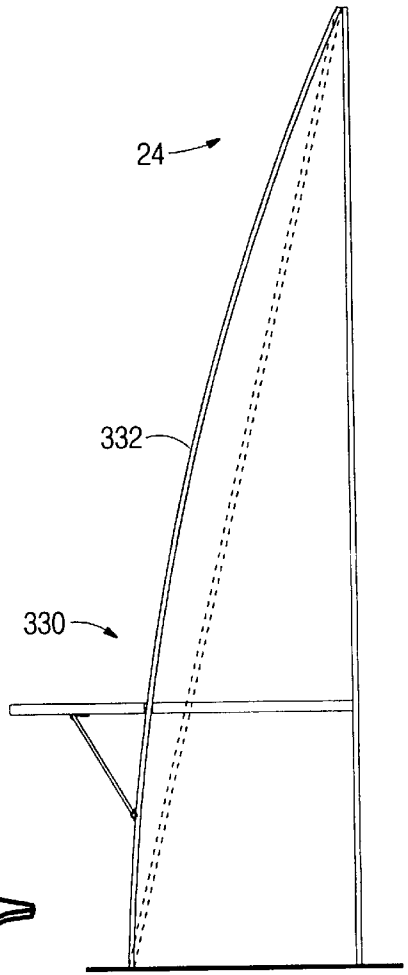
FIG. 9C is a fragmentary side elevation view of the workstation of FIG. 9B.
Figure 9B:
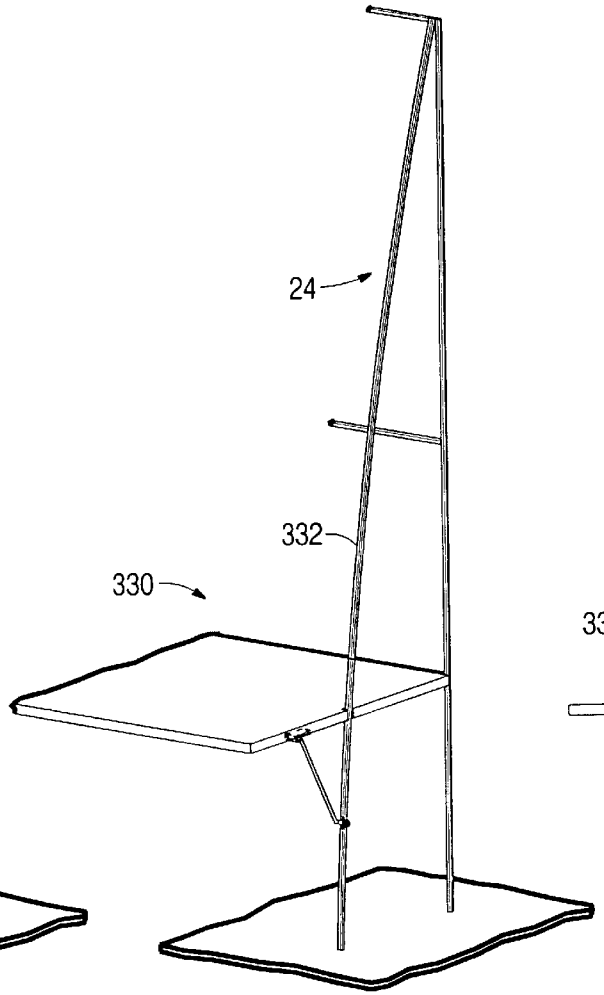
FIG. 9B is a fragmentary perspective view of the work station of FIG. 9A.
Figure 9A:
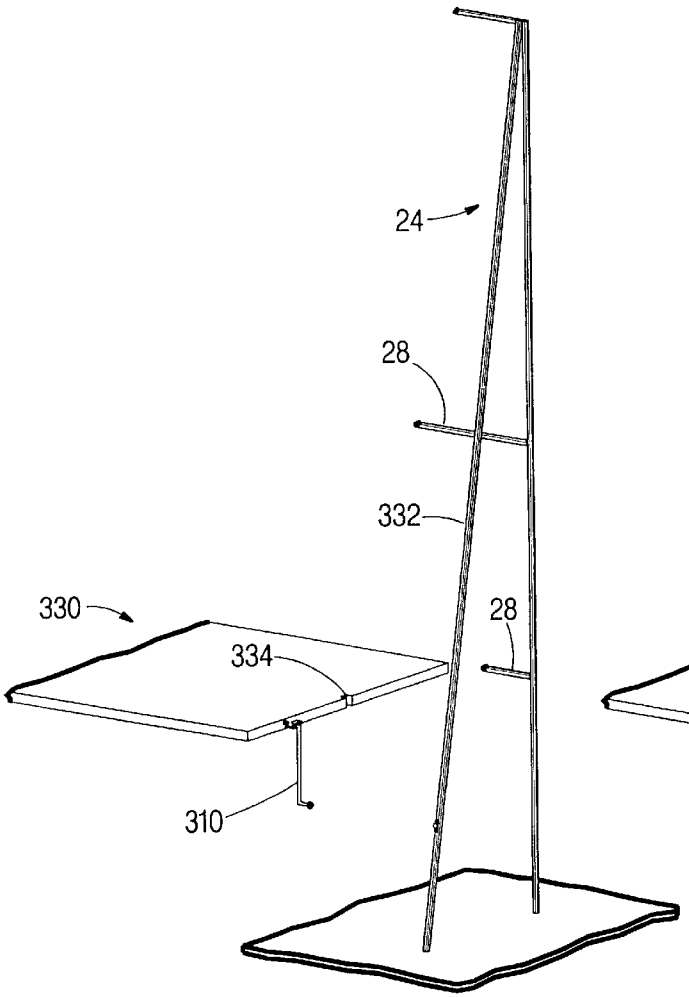
FIG. 9A is a fragmentary exploded perspective view of a work station according to an exemplary embodiment.

FIGS. 9A through 9C show attachment of a worksurface 330 to frame system 24 according to an exemplary embodiment. Worksurface 330 couples to beam 28 by engagement of tabs 282 (extending from a rear surface of worksurface 330) with slots 284 in beam 28 (as shown in FIGS. 8A through 8C). Support brace 310 couples worksurface 330 and an angled member 332. When assembled, angled member 332 is positioned in a groove (shown as a notch 334 in side 336 of worksurface 338). To position angled member 332 in notch 334, angled member 332 is flexed or bowed generally away from panel 26 (in FIG. 9C where the phantom lines represent a straight line between ends of angled member 332). According to an alternative embodiment, the space is provided by an U-shaped clip attached to the side of the worksurface.

Figure 10:
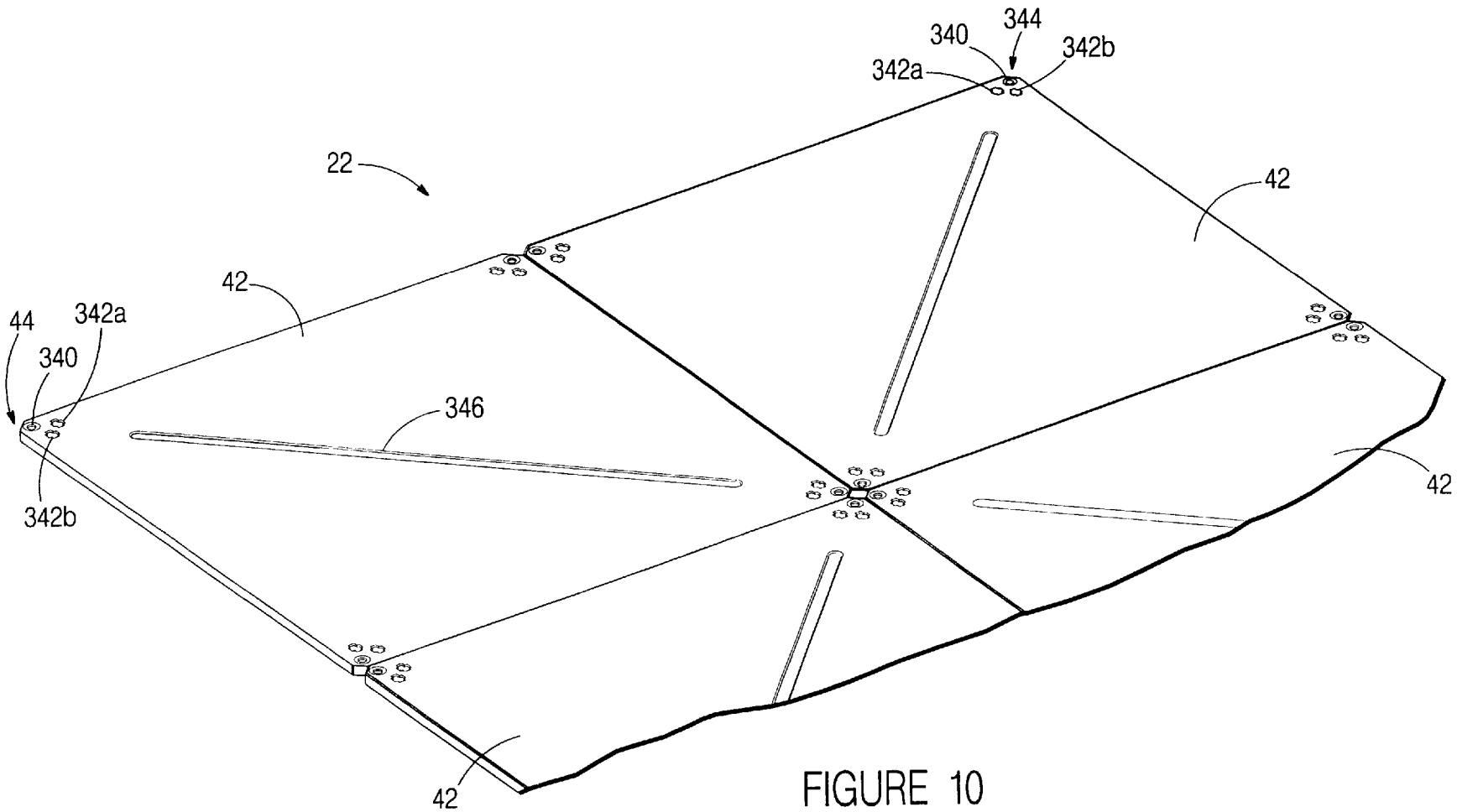
FIG. 10 is a fragmentary perspective view of a floor of the work environment of FIG. 1 according to an exemplary embodiment.

FIG. 10 shows floor 22 according to an exemplary embodiment. Floor 22 includes floor tiles 42 positioned and arranged to provide floor 22. Each floor tile 42 includes a plurality of apertures 340, 342*a*, 342*b* at each corner 344. Apertures 342*a*, 342*b* are intended to receive a latch mechanism to couple frame system 24 to floor 22. Aperture 340 is intended to receive a fastener (not shown) to couple floor tile 42 to base 46 (see FIGS. 3A–3K). An indent 346 in upper surface of floor tiles 42 is provided for rigidity and strength. As shown by the plurality of apertures, any of a variety of section wall attachments may be made in any of a variety of wall configurations, designs, shapes, etc. (i.e., intended to provide modularity and flexibility in space design).

It is important to note that the construction and arrangement of the elements of the frame system in the preferred and other exemplary embodiments is illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. Accordingly, all such modifications are intended to be included within the scope of the present invention as defined in the appended claims. Other substitutions, modifications, changes and omissions may be made in the design, operating conditions and arrangement of the preferred and other exemplary embodiments without departing from the spirit of the present invention as expressed in the appended claims.

What is claimed is:

1. A workstation for a work environment having a floor, the workstation comprising:

a plurality of frame sections having vertical posts attachable to the floor;

a plurality of panels interconnectable to at least one of the frame sections;

a worksurface attachable to at least one of the frame sections;

a latch mechanism configured to operate between a released position and latched position to releasably and rigidly secure the vertical posts of the frame sections to the floor so that the workstation may be quickly and easily coupled to and uncoupled from the floor;

wherein an interference fit is provided by a clip coupled to the latch mechanism.

2. The workstation of claim 1 wherein the panels are attached to a frame member by an interface fit.

3. The workstation of claim 1 wherein the worksurface is attached to the at least one of the frame sections by a bracket member.

4. The workstation of claim 1 wherein the frame sections are horizontal frame members.

5. The workstation of claim 1, wherein the clip includes inwardly biased flanges in operable engagement with a wedge, wherein the wedge spreads apart the flanges of the clip to provide an interference fit between the flanges and the floor.

6. The workstation of claim 5 further comprising a sleeve configured to receive the wedge.

7. The workstation of claim 5, wherein the latch mechanism is configured to selectively extend and retract the wedge along a longitudinal axis of the vertical posts.

8. The workstation of claim 1 wherein the plurality of frame members are configured for assembly with at least one connector.

9. A workstation for a work environment having a floor, the workstation comprising:

a plurality of frame sections having vertical posts attachable to the floor;

a plurality of panels interconnectable to at least one of the frame sections;

a worksurface attachable to at least one of the frame sections;

a latch mechanism configured to operate between a released position and latched position to releasably and rigidly secure the vertical posts of the frame sections to the floor so that the workstation may be quickly and easily coupled to and uncoupled from the floor; and a connector for coupling panels to the frame sections, the connector comprising a pair of brackets with tabs so that the brackets may be quickly released from the frame sections.

10. The workstation of claim 9 further comprising a cap disposed between adjacent frame members and configured to provide a biasing force.

11. The workstation of claim 9 wherein the latch mechanism comprises a lever.

12. The workstation of claim 9 further comprising means for connecting adjacent ones of the plurality of frame sections.

13. A workstation for a work environment having a floor, the workstation comprising:

a plurality of frame sections having vertical posts attachable to the floor;

a plurality of panels interconnectable to at least one of the frame sections;

a worksurface attachable to at least one of the frame sections;

a latch mechanism configured to operate between a released position and latched position to releasably and rigidly secure the vertical posts of the frame sections to the floor so that the workstation may be quickly and easily coupled to and uncoupled from the floor; and a connector for coupling panels to the frame sections, the connector comprising a pair of brackets coupled by a web.

14. The workstation of claim 13 wherein a portion of the latch mechanism is inserted into an aperture in the floor.

15. The workstation of claim 14 wherein the aperture is rectangular.

16. The workstation of claim 13 wherein the latch mechanism is a pivoting latch.

17. The workstation of claim 13 wherein the latch mechanism comprises an extendable rod member.

18. A workstation for a work environment having a floor, the workstation comprising:

a plurality of frame sections having vertical posts attachable to the floor;

a plurality of panels interconnectable to at least one of the frame sections;

a worksurface attachable to at least one of the frame sections;

a latch mechanism configured to operate between at released position and latched position to releasably and rigidly secure the vertical posts of the frame sections to the floor so that the workstation may be quickly and easily coupled to and uncoupled from the floor;

a connector for coupling panels to the frame sections;

wherein the latch mechanism is a buckle.

19. The workstation of claim 18 wherein the worksurface is at least partially supported by a brace member.

20. The workstation of claim 18 further comprising a plurality of floor panels having at least one aperture configured to engage the latch mechanism.

21. A workstation for a work environment having a floor, the workstation comprising:

a plurality of frame sections having vertical posts attachable to the floor;

a latch mechanism configured to releasably and rigidly secure at least one frame section to the floor, the latch mechanism including:

a latch coupled to one of the frame sections;

a wedge coupled to the latch;

a clip disposed between the latch and the wedge, the clip having a pair of flanges with ends capable of being disposed at least partially beneath the floor;

wherein the latch is configured to move the wedge between the flanges of the clip to operate the latch mechanism between a latched position and a released position;

so that the workstation may be quickly and easily disassembled.

22. The workstation of claim 21 wherein the latch mechanism includes a pivoting latch.

23. The workstation of claim 21 wherein the latch mechanism includes a base mounted to one of the vertical posts, an arm coupled to the base, and a loop coupled to the arm and the one of the vertical posts.

24. The workstation of claim 21 wherein an interference fit is provided by ends of flanges.

25. The workstation of claim 21 wherein the latch mechanism includes a lever.

26. The workstation of claim 21 further including a connector for coupling panels to the frame section.

27. The workstation of claim 21 wherein a portion of the latch mechanism is inserted into an aperture in the floor.

28. The workstation of claim 27 wherein the aperture is rectangular in shape.

29. A workstation for a work environment having a floor having an aperture, the workstation comprising:

a plurality of frame sections having vertical posts attachable to the floor;

a latch mechanism releasably and rigidly securing at least one frame section to the floor, the latch mechanism including:

a sleeve coupled to one of the frame sections;

a wedge configured to be inserted into sleeve;

wherein the wedge is configured to be inserted into the sleeve so that an end of the wedge is at least partially disposed within the aperture;

so that the workstation may be quickly and easily disassembled.

30. The workstation of claim 29 wherein the latch mechanism includes a sliding latch.

31. The workstation of claim 29 further including a connector for coupling panels to the frame section.

32. The workstation of claim 29 wherein a portion of the latch mechanism is inserted into an aperture in the floor.

33. The workstation of claim 32 wherein the aperture is rectangular.

34. The workstation of claim 29 further including a worksurface having a groove, wherein the plurality of frame sections includes an angled support configured to be engageable with the groove of the worksurface when in a flexed position.

35. The workstation of claim 29 further including a worksurface having one or more tabs extending from a back surface and a quick release connector, wherein the tabs are configured to engage slots in one of the frame sections and the quick release connector is configured to be releasably coupled with one of the frame sections.

* * * * *